United States Patent [19]

Vacanti

[11] Patent Number: 4,700,403

[45] Date of Patent: Oct. 20, 1987

[54] PROTECTIVE CUSHION

[75] Inventor: Eugene J. Vacanti, Eden Prairie, Minn.

[73] Assignee: Sports Marketing, Inc., Eden Prairie, Minn.

[21] Appl. No.: 939,258

[22] Filed: Dec. 5, 1986

Related U.S. Application Data

[63] Continuation of Ser. No. 726,132, Apr. 23, 1985, abandoned, which is a continuation-in-part of Ser. No. 409,014, Aug. 17, 1982, Pat. No. 4,512,037.

[51] Int. Cl.[4] ..... A41D 13/00; A43B 13/38

[52] U.S. Cl. ..... 2/2; 2/22; 2/267; 2/DIG. 3; 36/44; 36/71; 5/434

[58] Field of Search ..... 2/2, 22, 267, DIG. 3; 36/44, 71; 5/434

[56] References Cited

U.S. PATENT DOCUMENTS

| | | | |
|---|---|---|---|
| 1,744,384 | 1/1930 | Hood | 2/22 |
| 2,368,433 | 1/1945 | Terry | 2/24 |
| 2,609,537 | 9/1952 | Pfaff | 2/22 |
| 2,818,571 | 1/1958 | Grant | 2/22 |
| 3,044,075 | 7/1962 | Rawlings | 2/22 |
| 3,088,115 | 5/1963 | Groot | 2/2 |
| 3,248,738 | 5/1966 | Morgan | 2/2 |
| 3,257,666 | 6/1966 | Hoffman | 2/2 |
| 3,307,318 | 3/1967 | Bauman | 52/743 |
| 3,327,449 | 6/1967 | Hullhorst et al. | 53/438 |
| 3,344,433 | 10/1967 | Stapenhill | 2/420 |
| 3,477,067 | 11/1969 | Aileo | 2/DIG. 6 |
| 3,507,727 | 3/1970 | Marshack | 5/434 |
| 3,541,752 | 11/1974 | Ness | 53/436 |
| 3,784,984 | 1/1974 | Aileo | 2/423 |
| 3,897,596 | 8/1975 | Aileo et al. | 2/423 |
| 3,909,847 | 10/1975 | Holt et al. | 2/2 |
| 3,994,023 | 11/1976 | Aileo et al. | 2/417 |
| 3,999,229 | 12/1976 | Keltner | 2/413 |
| 4,023,209 | 5/1977 | Frieder, Jr. et al. | 2/6 |
| 4,120,052 | 10/1978 | Butler | 2/16 |
| 4,204,373 | 5/1980 | Davidson | 52/204 |
| 4,290,149 | 9/1981 | Aileo | 2/414 |
| 4,324,012 | 3/1982 | Cannaday | 5/432 |
| 4,325,148 | 4/1982 | Livernois | 2/2 |
| 4,486,901 | 12/1984 | Donzis | 2/2 |

*Primary Examiner*—Werner H. Schroeder
*Assistant Examiner*—J. L. Olds
*Attorney, Agent, or Firm*—Burd, Bartz & Gutenkauf

[57] ABSTRACT

A protective pad assembly usable primarily by athletes to protect body parts from injury, especially from traumatic shock as when struck by a high speed hockey puck. The pad assembly includes a relatively rigid outer shell or shield and an inner air entrained cushion releasably attached to the outer shell and closely conformable to the body part being protected. The cushion includes a flexible, shock absorbent pad covered by a flexible air impervious case. The pad is formed of a soft, springy material which expels air upon compression, such as polyurethane foam. Small openings in the case are provided for expulsion of air from the case upon deflection of the pad as under the influence of the force of impact of an external object. The amount and rate at which air is expelled from the case influences the resiliency and shock absorbency characteristics of the cushion.

32 Claims, 22 Drawing Figures

Fig. 1
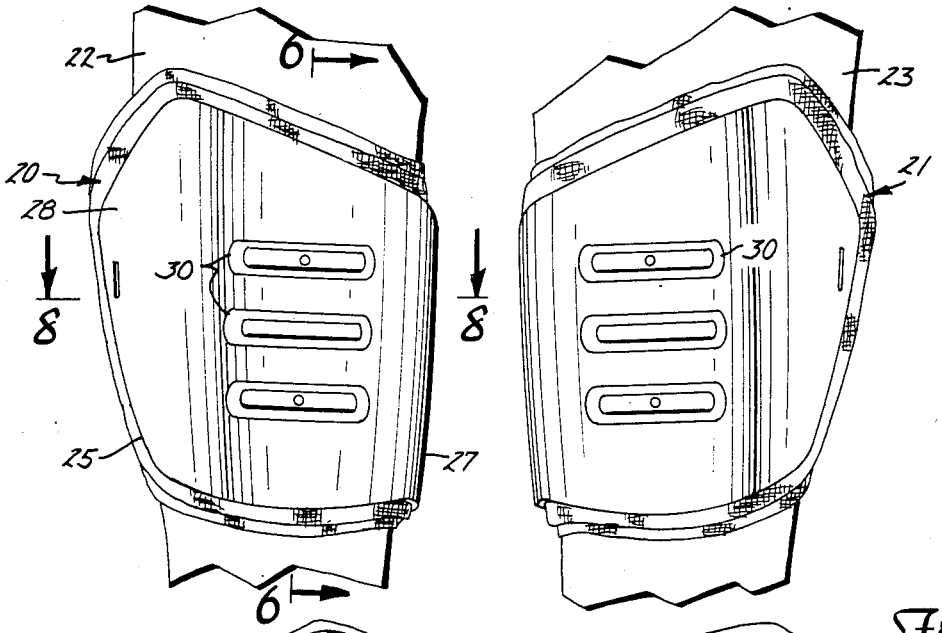
Fig. 2
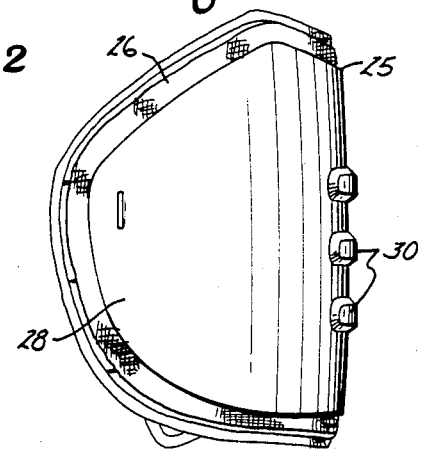
Fig. 3
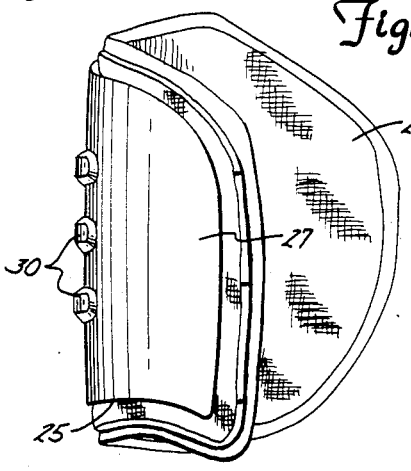
Fig. 4
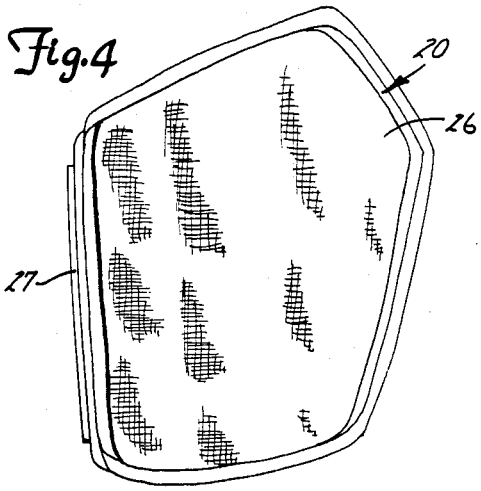
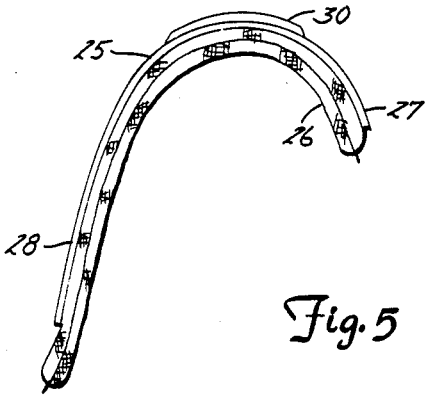
Fig. 5

PROTECTIVE CUSHION

CROSS REFERENCE TO RELATED APPLICATIONS

This application is a continuation of U.S. application Ser. No. 726,132 filed Apr. 23, 1985, now abandoned. Application Ser. No. 726,132 is a continuation-in-part of application Ser. No. 409,014, filed Aug. 17, 1982, now U.S. Pat. No. 4,512,037.

BACKGROUND OF THE INVENTION

The invention pertains to the field of protective garments and more particularly to protective pad assemblies for use primarily by athletes and also by others engaged in hazardous activity whre there is a risk of traumatic impact to a portion of the body.

Certain sports pose such a high degree of risk of injury for the sport participant that protective equipment is desirable and usually required for the participant to be protected against injury. The sport of hockey, for example, is is particularly hazardous due to the high velocity imparted to the puck as well as the momentum generated by swinging hockey sticks.

In the design and construction of protective equipment, weight and cost are consideration as well as the agility of the player while wearing the equipment and the possibility of injury to other players by the equipment.

SUMMARY OF THE INVENTION

The invention pertains to protective pad assemblies usable primarily in protective equipment for sports participants to protect body parts from injury in general and particularly from traumatic shock which can result in dangerous injury as when a player is struck by a high speed hockey puck. the pad assembly can be formed for protection of specific body parts, such as thighs, hips, shins, chest, foot or other vulnerable body parts. The first embodiment of the pad assembly has a relatively rigid outer shell or shield formed in general conformance with the body part to be protected. An inner air entrained cushion is releasably attached to the outer shell and closely conforms to the body part. The cushion includes a flexible shock absorbent pad covered by a flexible air impervious case. The pad is formed of a soft springy material which expels air upon compression such as an open cell plalstic foam. The pad fills the entire case and is under nominal compression to keep the case taut. The case has a plurality of relatively samll openings for the purpose of causing the air therein to be compressed and permitting expulsion of compressed air upon deflection of the cushion due to an impact on the shield. The openings allow air to flow into the case and pad when the external force has been removed from the case and the pad expands to its normal shape. The amount and rate at which air is expelled from the case influences the resiliency and shock absorbency characteristics of the cushion. This is influenced by the size, location and number of openings in the case.

In use, an impact occasioned by an air borned object, another player, fixed objects, a swung stick or the like is initially repelled by the shield. The shield distributes the force of the impact over a somewhat larger area of the cushion. The cushion deflects and air therein compresses at a predetermined rate according to the compression characteristics of the pad and the amount of compressed air expelled from the case, at the same time absorbing the shock of the impact. The force finally transferred to the body part ,of the participant is dissipated over a relatively large area. Following, the cushion recovers its former volume and shape as air flows through the openings back into the case and pad. The cushion is removable from the shell for cleaning, interchanging with cushions of greater or less resiliency, repair or the like.

A second embodiment of the cushion is shaped to cover the chest and shoulder of a person. It has a flexible air impervious case surrounding a chamber. The case comprises flexible plastic and fabric sheets having outer peripheral edges sealed together. One or more openings are located in the sealed edges to allow restricted flow of air in and out of the chamber. A pad of resilient compressible open cell plastic foam is located within the chamber. The pad fills the entire chamber and is under nominal compression to keep the case taut. The pad and air in the chamber functions as combined compression spring means to absorb and distribute the force of an impact applied to the cushion. The amount and rate at which air flows from the chamber in the case and the location of the openings are factors that determine the resiliency and impact absorbing characteristics of the cushion.

A third embodiment of the cushion is a foot cushion or insole. This cushion has the shape of the sole of a human foot so that it can be placed in a shoe. The cushion functions to absorb and distribute impact force on the foot during walking, jogging, and running activities. The cushion has an air impervious case having an outer peripheral edge sealed together. Openings are provided in the ball and heel portions of the cushion. A pad of resilient compressible open cell plastic foam positioned within the case under nominal compression functions with the air within case as combined compression spring means to absorb and distribute the impact forces acting on the foot. The arch section of the cushion can be reinforced with stiff plastic foam.

The first cushion is constructed by initially compressing the pad and heat sealing it in the air impervious case while still compressed and prior to forming the air openings in the case. In such a state,. the pad remains compressed and the cushion is more compact for storage and shipment. Prior to installation in protective equipment, the air openings are installed and the pad expands to substantially fill the internal volume of the case. In the second and third embodiment of the cushion, openings are placed in the outer peripheral edge of the cushion during the sealing thereof.

IN THE DRAWING

FIG. 1 is a ront elevational view of a pair of pad assemblies of the invention, comprised as thigh pad assemblies for the sport of hockey fitted on the legs of a sport participant;

FIG. 2 is a right side elevational view of the right thigh pad assembly of FIG. 1;

FIG. 3 is a left side elevational view of the right thigh pad assembly of FIG. 1;

FIG. 4 is a rear elevational view of the right thigh pad of FIG. 1;

FIG. 5 is a top plan view of the right thigh pad assembly of FIG. 1;

DESCRIPTION OF A PREFERRED EMBODIMENTS

Figure 6:
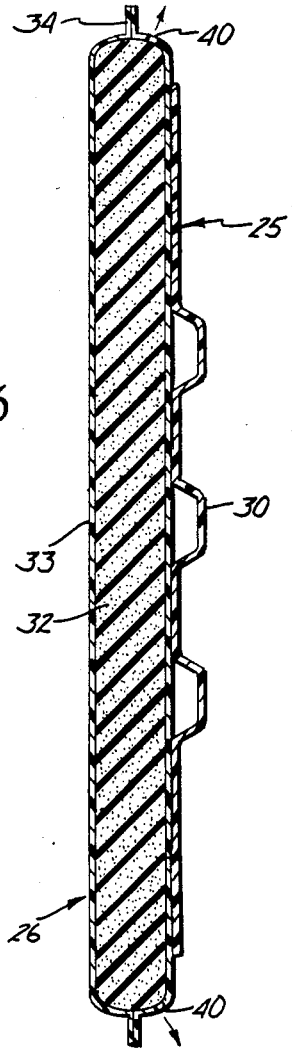
FIG. 6 is an enlarged sectional view of the thigh pad assembly of FIG. 1 taken along the line 6—6 of FIG. 1.
Figure 7:
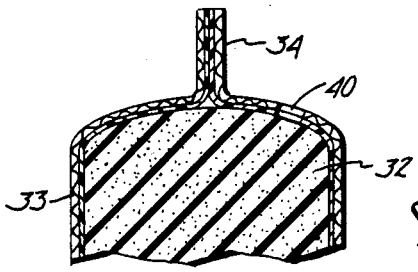
FIG. 7 is an enlarged sectional view of the upper end of the thigh pad assembly shown in FIG. 6.

Referring to the drawing, there is shown in FIG. 1 a pair of protective pad assemblies according to the invention comprised as symmetrical right and left thigh pad assemblies 20, 21 usable for hockey, fitted on thighs 22, 23 of a hockey player. Pad assemblies 20,21 are effective to deflect blows from objects, such as pucks, hockey sticks and protective equipment, and absorb and disperse the force of impact over a large area of the protected thigh. Pad assemblies 20, 21 are for installation in suitable pockets provided in hockey pants (not shown) to hold the pad assemblies in proper position with respect to the thighs. Releasable straps can be used to retain pad assemblies 20 and 21 on the thighs.

As shown in FIGS. 1 through 5, the right thigh pad assembly 20 includes an outer shell or shield 25 comprised of a strong, relatively rigid but somewhat pliable material such as vacuum formed plastic. Shield 25 is shaped to conform generally to the thigh of a hockey player but substantially larger in order to accommodate an air cushion 26. Shield 25 protects the medial, forward and distal portions of the thigh, having a medial side 27 located on the inside portion of the thigh, curving around the front of the thigh to the distal portion 28 located on the outside portion of the thigh. The surface of shield 25 diverges somewhat upwardly at the distal portion 28 in order to protect the greater exposed area on the outside of the leg. Shield 25 has a plurality of spaced apart, outwardly extended horizontal ribs 30 located on the front thereof. Ribs 30 serve to deflect objects that approach shield 25 from substantially a head-on direction as a speeding hockey puck. Ribs 30 also impart a measure of additional strength to the front portion of shield 25.

Cushion 26 is releasably fitted to the interior surface of shield 25. The outer perimeter of cushion 26 conforms substantially to the outer perimeter of shield 25 but is slightly larger as shown in the drawings. Cushion 26 is removable for purposes of interchangeability with cushios of greater or less thickness, or for cleaning, repair or the like. When fitted on a leg, cushioi 26 closely conforms to the surface of the thigh.

Figure 9:
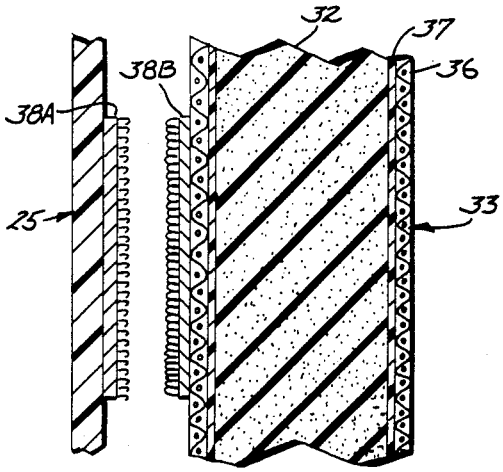
FIG. 9 is an enlarged exploded sectional view of a portion of the thigh pad assembly of FIG. 8 taken along the line 9—9 of FIG. 8.

Referring to FIGS. 6 through 9, air cushion 26 includes a soft shock absorbent pad 32 and a flexible case 33 of air impervious material. Pad 32 is formed of a springy, compressible air entrained material of the type that expels air upon compression such as open cell foam rubber and plastic foam, and plastic foam, and substantially fills the interior volume of case 33. An example of a suitable material is a sheet of polyurethane ether foam having a density of 1.6 pounds per cubic foot. Other types of cellular foam plastic can be used for pad 32. Pad 32 has a thickness or depth of between one-half to one inch (1.27 to 2.54 cm.). The depth of the pad varies with the material and the use of the pad assemblies. Case 33 is formed of a pairof sheet members covering the sides of pad 32 and heat sealed along the edges forming a heat seal lip 34. As shown in FIG. 9, case 33 is comprised of an outer layer 36 of strong, durable and flexible material such as nylon fabric, and an inner layer 37 of air impervious material such as vinyl bonded to outer layer 36.

Figure 8:
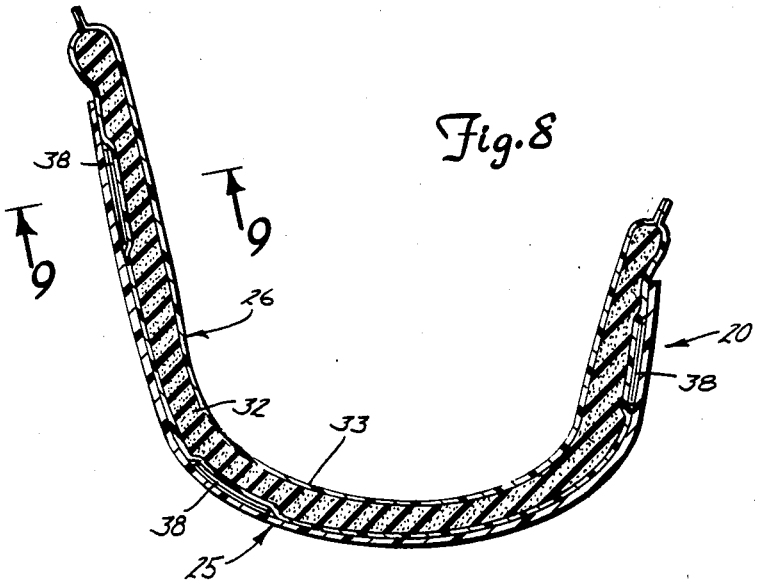
FIG. 8 is an enlarged sectional view of the thigh pad assembly of FIG. 1 taken along the line 8—8 of FIG. 1.

As shown in FIGS. 8 and 9, air cushion 26 is releasably fastened to the interior surface of shield 25 by releasable fastening strips 38 of the type having releasable interlocking surfaces that can be of the hook and loop type sold under the trademark Velcro. A plurality of first fastening strips 38A are secured to the interior surface of shield 25. A corresponding plurality of second fastening strips 38B are fastened on a side of cushion 26 located to properly position cushion 26 with respect to shield 25 when corresponding strips 38A and 38B are brought together as shown in FIG. 8.

A plurality of slit valves or small linear openings 40 are formed in case 33 to permit restricted "escape" of air from the interior thereof upon compression of pad 32 and compression of the air in cae 33 responsive to an impact, and permit entry of air into the case upon expansion or recovery of pad 32. In addition to the resiliency characteristics of pad 32, the amount and rate at which air is permitted to be expelled from case 33 influences the shock absorbency characteristics of cushion 26. If little or no air is permitted to escape, cushion 26 would feel hard. If air were permitted to escape freelyl, pad 32 would substantially collapse and offer minimal resistance to the force of impact. Accordingly, the permissible air escape is regulated by openings 40. The number, spacing and size of openings 40 are parameters in regulating the permissible air escape. For example, it is desirable to have openings 40 at the lateral ends of cushion 26. Upon a central impact upon shell 25, air escapes through the lateral ends upon dispersion of the impact force over a large area of pad 32 resulting in greater disperson of the force. Openings 40 can be provided at other locations along the perimeter of cushion 26.

In use, pad assemblies 20 and 21 are located adjacent the thighs of a hockey player as shown in FIG. 1. Pockets of a suitable hockey garment (not shown) retain the pad assemblies adjacent the thighs. In terms of injury to a hockey player, a high speed, air borne puck is a worrisome source of injury although blows from a hockey stick, accidentally or otherwise, are not uncommon as well as other potential sources of injury such as collision. An air borne hockey puck, for example, impacting upon a thigh pad assembly 20 is initially deflected by shield 25. Shield 25 serves also to somewhat disperse the force of the impact. The impact force causes a deflection of pad 32. Upon deflection, pad 32 absorbs much of the impact force at a rate controlled partially by the amount of air permitted to escape through openings 40. The force of impact transmitted to the hockey player is dispersed both in time duration and surface area by pad 32. Following deflection, pad 32 recovers its normal volume as air enters through the openings 40.

Figure 10:
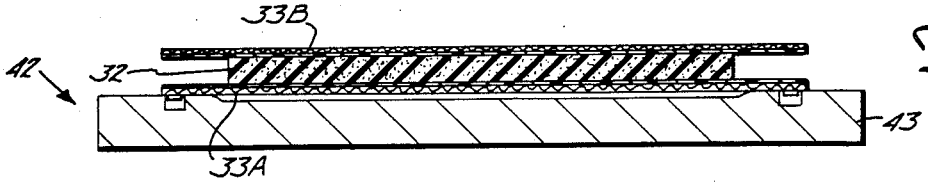
FIG. 10 is a diagramic view of a heat seal press used in the fabrication of the cushion of the thigh pad assembly showing the initial loading of the press.
Figure 11:
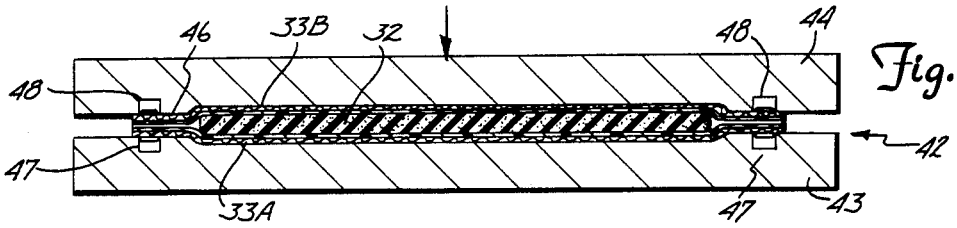
FIG. 11 is a view similar to FIG. 10 showing the compression of the cushion.
Figure 12:
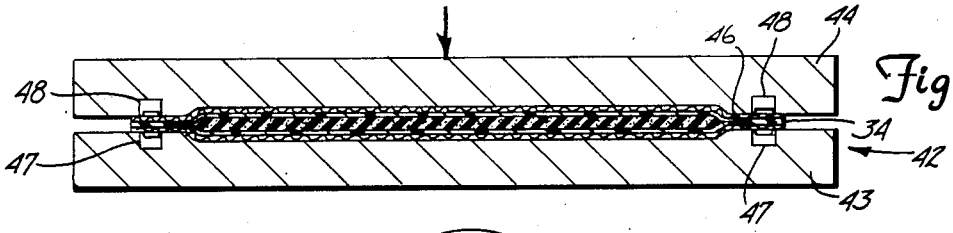
FIG. 12 is a view similar to FIG. 10 showing the heat sealing of the cushion.
Figure 13:
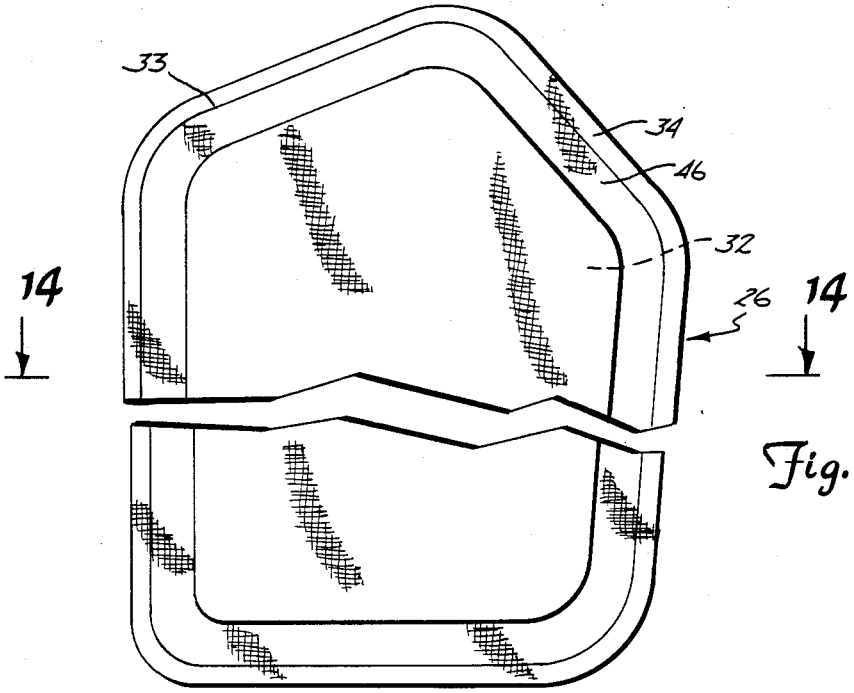
FIG. 13 is a plan view of the heat sealed cushion.
Figure 14:
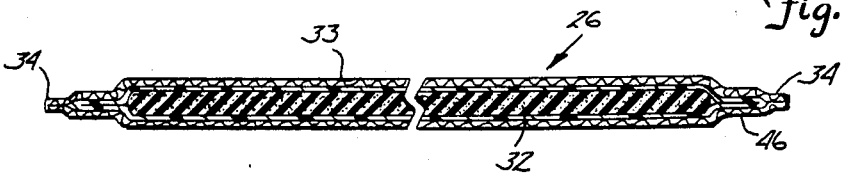
FIG. 14 is an enlarged sectional view of the heat sealed cushion of FIG. 13 taken along the line 14—14 of FIG. 13.
Figure 15:
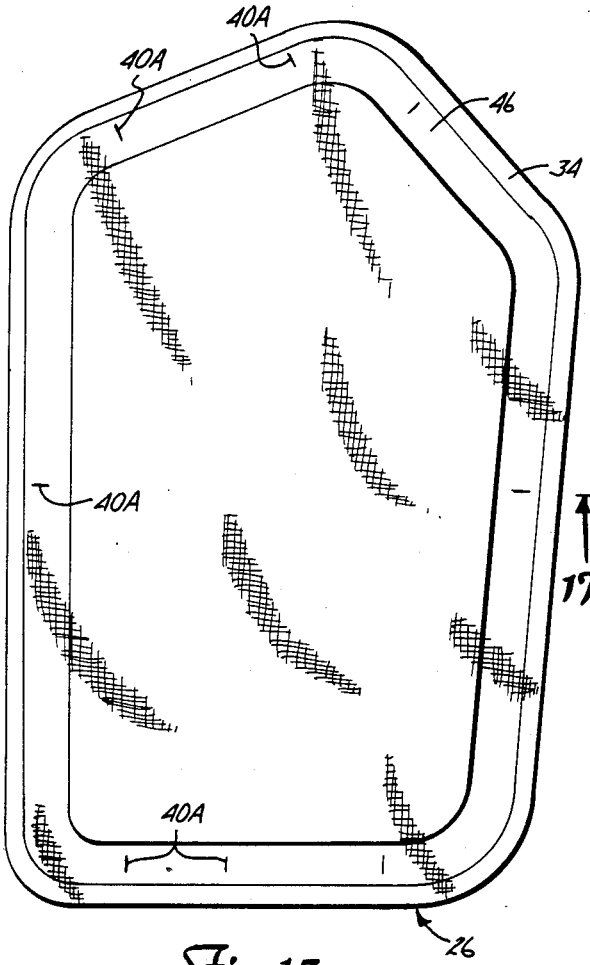
FIG. 15 is a plan view similar to that of FIG. 13 showing the vent openings scribed in the case of the cushion.
Figure 16:
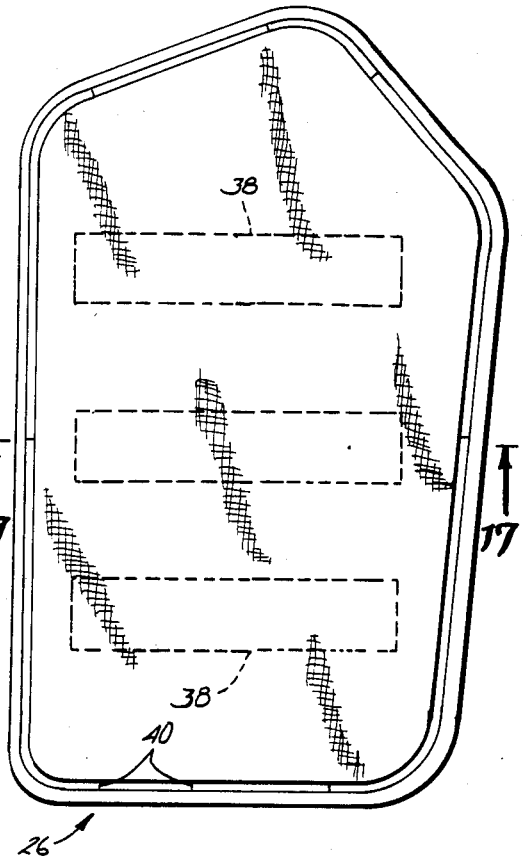
FIG. 16 is a plan view of the air expanded cushion.
Figure 17:
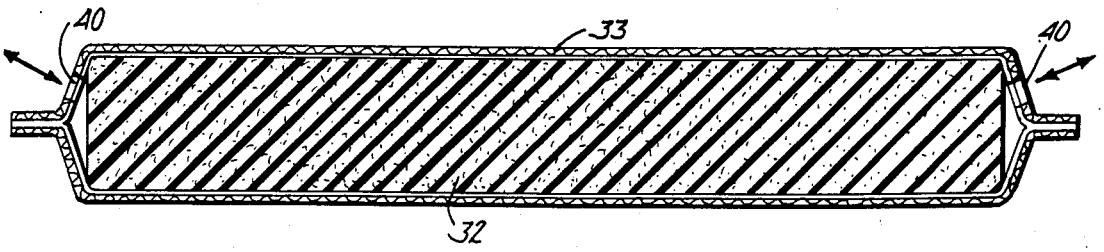
FIG. 17 is an enlarged sectional view of the air expanded cushion of FIG. 16 taken along the line 17—17 thereof.

In terms of a method of construction of a protective air cushion for use in athletic equipment, there is shown in FIG. 10 through 12 a heat seal press 42 having a lower platten 43 and an upper platten 44. A first sheet member 33A of case material is placed on lower platten 43. Sheet member 33A can be a durable, flexible material impervious to air such as a nylon fabric material bonded to a vinyl coating. An air entrained pad 32 of compressible material in expanded form is placed on sheet member 33A and a second sheet member 33B is placed over pad 32. Sheet members 33A, 33B have greater transverse dimensions than the pad 32. As shown in FIG. 11, upper platten 44 is lowered onto lower platten 43 to compress pad 32 between the sheet members 33A, 33B. A flange 46 is formed around the outer perimeter of sheet members 33A, 33B beyond location of pad 32. As shown in FIG. 12, lower platten 43 carries heating elements 47 and upper platten 44 carries heating elements 48. When the plattens reach the position of FIG. 12, practically all air has been expelled from pad 32 and from between the two sheet members 33A, 33B. Heat elements 47, 48 seal the outer lip 34 of flange 46 to complete case 33. In such configuration, as shown in FIGS. 13 and 14, air is removed from the interior of case 33 and pad 32 is very compact. In such a compressed configuration, cushion 26 is compact for storage or transportation. As a next step, as shown in FIG. 15, markings or scores 40A are placed in the perimeter or flange 46 of collapsed air cushion 26. Scores 40A do not penetrate the material of case 33 but are merely indicative of where the openings or slits 40 will later be formed. The scores 40A are placed according to criteria as earlier described depending on the resiliency and shock absorbency to be imparted to cushion 26 by the size, number and location of the eventual openings through the case 33.

Cushion 26 can be shipped and stored in the configuration as shown in FIG. 15. At the eventual time for usage of cushion 26, openings 40 are made at the location of the scores 40A to provide openings to admit air. Pad 32 expands with air to a volume permitted by the internal volume of case 33 which is not the total volume to which pad 32 would expand if unrestrained. When contained in a less than fully expanded state, pad 32 is under slight compression to keep case 33 taut. Flange 46 expands to become the side wall of case 33. Fastening strips 38 can be applied to the case 33 for preparation for use with a shield 25.

Referring to FIGS. 18 to 21, there is shown a second modification of the cushion indicated generally at 100. Cushion 100 is a chest and shoulder cushion to protect the right side of the body. A second chest and shoulder cushion of the same design is used to protect the left side of the body. Cushion 100 has an air impervious case indicated generally at 101. Case 101 has a pair of flexible air impervious sheet members 102 and 103 that are sealed together at their outer peripheral edges 104. The outer peripheral edges 104 are sealed together with a heat seal, vulcanization, welding or the like. Each flexible sheet has an air impervious plastic layer bonded to a fabric or cloth layer. Preferably, the cloth layer is on the external side of the cushion.

Case 101 has a chamber 106 for accommodating air and a compressible cellular pad 107. Preferably, pad 107 is a foam plastic or rubber open cell structure that has a memory to return it to its original flat position. Pad 107 is generally flat having a flat upper and lower sides that are located in surface engagement with the inside surfaces of the flexible sheet members 102 and 103. Pad 107 is retained under nominal compression within the chamber 106 by flexible sheet members 102 and 103. Pad 107 fills the entire chamber 106 and maintains the flexible sheet members 102 and 103 in a generally taut condition. The expanded volume of chamber 106 is less than the normal expanded size of pad 107 so that the spring or expansion force of pad 107 is continuously maintained on sheet members 102 and 103.

Figure 18:
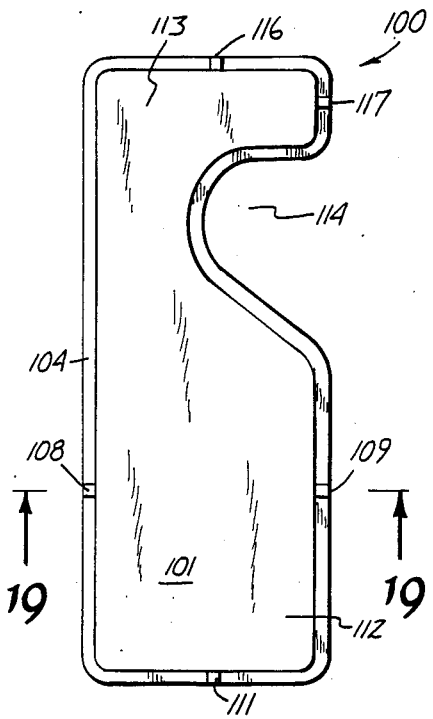
FIG. 18 is a plan view of a second embodiment or chest and shoulder cushion.

As shown in FIG. 18, outer peripheral edges 104 have a plurality of openings 108, 109,116, and 117. These openings are in the seal joining outer peripheral edges 104. Openings 108 and 109 and 111 are located in chest portion 112 of cushion 110. Openings 108 and 109 are in opposite side edges of outer peripheral edges 104. Opening 111 is centrally located in the bottom section of peripheral edges 104. Openings 116 and 117 are located in shoulder portion 113 of cushion 100. A generally U-shaped recess 114 is interposed in one side of the cushion to accommodate the neck of the user.

In use, when an object such as a puck 121, moving in direction of arrows 122 hits cushion 100 the air in chamber 106 and in pad 107 will be compressed and pad 107 will be compressed. The air in the chamber and within the pad 107 will move toward outlet openings 108, 109, 111, 116 and 117. These openings are relatively small in size and restrict the flow of air that can be forced from chamber 106 and pad 107. The combined compression of the air and the compression of pad 107 absorbs the impact force of the puck and distributes the force to a large area of the body of the user that engages sheet member 103. When the force of the puck 121 is moving in the direction of the arrows 122 is dissipated, pad 107 will return to its initial nominal compressed condition. This causes the air as shown in arrows 118 and 119 to flow back through the openings 108, 109, 111, 116 and 117 into pad 107 and chamber 106.

Figure 22:
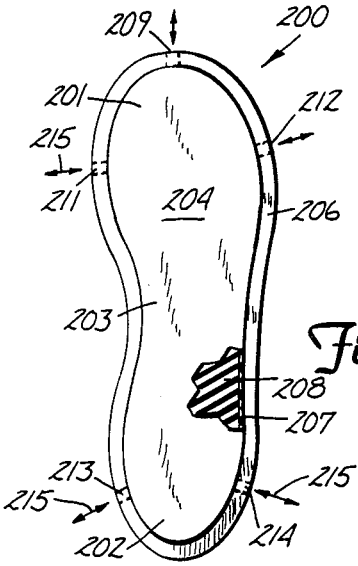
FIG. 22 is a plan view of a third embodiment or foot cushion.

Referring to FIG. 22, there is shown a third modification of the cushion indicated generally at 200. Cushion 200 is in the shape of a bottom of a foot and is in an insole for use with the shoe. Cushion 200 follows the shape of the right foot. The mirror image of cushion 200 is used with the left foot. Cushion 200 has a ball portion 201 and a heel portion 202. Intermediate ball and heel portions is an arch section 203.

Figure 19:
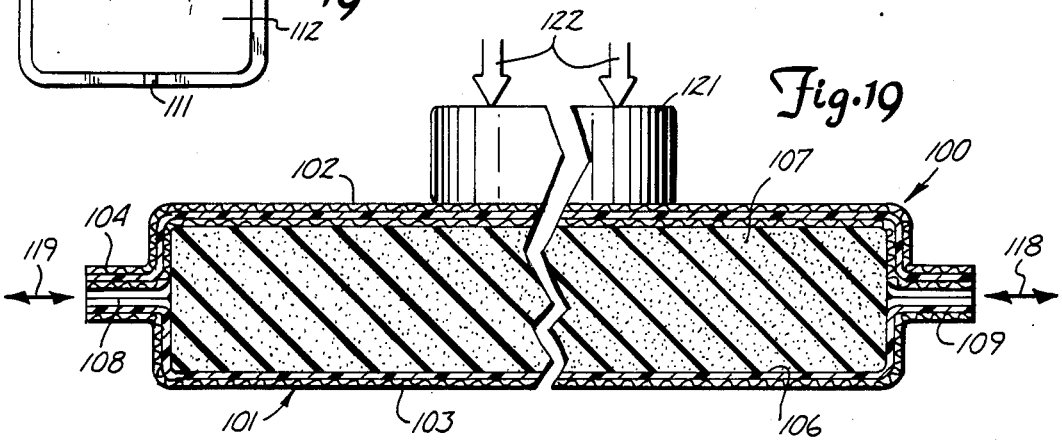
FIG. 19 is an enlarged foreshortened sectional view taken along the line 19—19 of FIG. 18.
Figure 20:
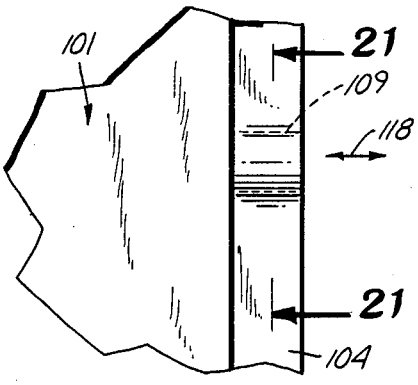
FIG. 20 is an enlarged portion of the outer peripheral edge of the cushion of FIG. 18.
Figure 21:
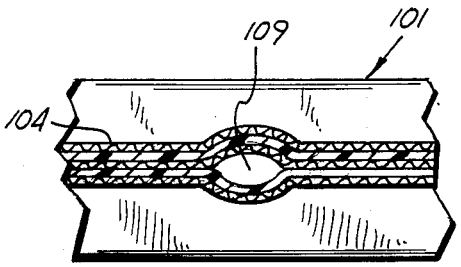
FIG. 21 is a sectional view taken along line 21—21 of FIG. 20.

Cushion 200 has an air impervious case 204 having an outer peripheral edge 206. Case 204 can be constructed of the same material as the sheet members 102 and 103 as shown in FIG. 19. Case 204 has a chamber 206 accommodating a resilient compressible pad 208 of an open cellular material such as foam rubber or foam plastic. Pad 208 fills the entire chamber 207 and is under nominal compression within case 204. The outer peripheral edge 206 has a central toe opening 209 and ball openings 211 and 212 on opposite sides of the ball portion 201 of the cushion. The edge 206 has a pair of heel openings 213 and 214 located on opposite sides of the hell portion 202. Openings 209, 211, 212, 213, and 214 are in the seal of edge 206 and function to allow air to escape and be drawn into the chamber 207 and pad 208 during walking, jogging and running activities. The arch sectio 203 of the cushion 200 can be reinforced with additional pad material or pad material having greater compressive strength to provide for an arch support for the person's foot. The outer peripheral edge 206 does not have an opening in adjacent the arch support so that the pressure of the air and the compressive strength of the pad is not diminished to reduce the support for the arch of the foot.

While there has been shown and described athletic protective equipment comprised as a thigh pad assembly, and cushions, it is apparent that shield and cushions could be configured for protection of other parts of the body such as hips, kidneys, shins, chest, shoulder, foot, and the like. It will be apparent to those skilled in the art that other deviations and changes could be had from the configuration shown without departing from the scope and spirit of the invention.

The embodiments of the invention in which as exclusive property or privileges is claimed are defined as follows:

1. A protective cushion for protection of a human body part from injury comprising: flexible case means having an outer periphery shaped to conform to the part of the body that is to be protected, said case means having air impervious flexible first and second sheet members enclosing a single internal chamber, said sheet members having adjacent outer peripheral edges sealed together whereby said sheet members are flexible walls surrounding said internal chamber, said sealed outer peripheral edges having opposite ends and opposite sides, pad means of compressible open cell plastic material located within said chamber, said pad means being of a size to substantially fill said internal chamber, said chamber having internal dimension less than the fully expanded corresponding dimension of the pad means whereby the pad means is retained under partial compression within the chamber by the walls of the case means, said outer peripheral edges having at least one opening in the sealed portion thereof to allow restricted air flow into and out of the chamber and the open cell material of the pad means and regulate the pressure of the air in the open cells of the material of the pad means whereby the pad means and air in the open cells of the pad means simulatneously absorb and distributes impact forces applied thereto.

2. The cushion of cliam 1 wherein: the pad means is a generally flat pad located in engagement with the walls of the case means.

3. The cushion of claim 1 wherein: the sealed outer peripheral edges of the cushion had openings in the opposite ends thereof.

4. The cushion of claim 1 wherein: the sealed outer peripheral edges have openings in the opposite sides thereof.

5. The cushion of claim 1 wherein: the sealed outer peripheral edges of the cushion have openings in the opposite ends and opposite sides thereof.

6. The cushion of claim 1 wherein: the cushion has the general shape of the bottom of a person's foot.

7. The cushion of claim 6 wherein: the sealed outer peripheral edges of the cushion have openings in the opposite ends thereof.

8. The cushion of claim 6 wherein: the sealed outer peripheral edges have openings in the opposite sides thereof.

9. The cushion of claim 6 wherein: the sealed outer peripheral edges of the cushion have openings in the opposite ends and opposite sides thereof.

10. The cushio of claim 1 wherein: said cushion has a chest portion and a shoulder portion, one side of the cushion having a recess to accommodate the neck of a person.

11. A cushion for use to protect a human body part from injury comprising: a pad of air entrained, springy compressible open cell material; a case having a pair of sheet members surrounding a single chamber accommodating said pad, said sheet members having adjacent outer peripheral edges sealed together to enclose the pad between the sheet members, said sheet members being of an air impervious flexible material, said pad being of a size to substantially fill said internal chamber, said chamber having an internal dimension less than the fully expanded corresponding dimension of the pad whereby the sheet members hold the pad in partial compression within the chamber, and means located in said outer peripheral edges regulating permissible air flow out of the chamber and open cells of the pad and pressure of the air in the open cells of the pad upon compression of the pad due to impact of an external force whereby the pad and air in the open cells of the pad simultaneously absorb and distribute impact forces applied thereto and flow of air into the chamber and the open cells of the pad upon expansion of the pad, said means regulating air flow including at least one opening in the sealed outer peripheral edges of the sheet members.

12. The cushion of claim 11 wherein: means regulating the permissible air flow out of the case include a plurality of small openings of size, number and spacing claibrated to regulate air flow from the case upon deflection from impact of an external force.

13. The cushion of claim 11 wherein: said case comprises a first layer of flexible, durable, Nylon type fabric material; and a second layer of air impervious vinyl type material.

14. The cushion of claim 11 wherein: said outer peripheral edge has opposite sides, said means regulating air flow comprise openings in said opposite sides.

15. The cushion of claim 11 wherein: said outer peripheral edge has opposite ends, said means regulating air flow comprise openings in said opposite ends.

16. The cushion of claim 11 wherein: said outer peripheral edge has opposite sides and opposite ends, said means regulating air flow comprise openings in said opposite sides and opposite ends.

17. The cushion of claim 11 wherein: the cushio has the general shape of the bottom of a person's foot.

18. The cushion of claim 11 wherein: the cushion has a chest portion and a shoulder portion, one side of said cushion having a recess to accommodate the neck of a person.

19. A cushion for a shoe to absorb and distribute impact forces on a human foot comprising: flexible case means having a general shape to conform to the bottom of a foot and fit into a shoe, said case means having air impervious walls sealed together at the outer peripheral edges thereof forming an internal chamber, said sealed outer peripheral edges having opposite toe and heel portion and opposite sides, pad means of compressible open cell material located within said chamber, said pad means being of a size to substantially fill said chamber, said chamber of the case means having an internal dimension less than the fully expanded corresponding dimension of the pad means whereby the pad means is retained under nominal compression within the chamber by the walls of the case means, said outer peripheral edges having at least one opening in the sealed portion thereof to allow restricted air flow into and out of the chamber and pad means regulating the pressure of the air in the chamber whereby the pad means and air in the open cells of the pad means simultaneously absorbs and distributes impact force applied to the foot during walking and running activities.

20. The cushion of claim 19 wherein: the sealed outer peripheral edges of the cushio have openings in the toe end and heel portion.

21. The cushion of claim 20 wherein: the sealed outer peripheral edges of the cushion have openings in at least one side thereof.

22. The cushion of claim 19 wherein: the outer peripheral edges have openings in the opposite sides thereof.

23. A cushion for use with a shoe to absorb and distribute impact forces on a human foot applied to the foot during walking and running activities comprising: flexible case means having a general shape to conform to the bottom of a person's foot and to fit into the bottom of the inside of a shoe, said case means having air impervious walls and outer peripheral edges connected together to form a single internal chamber, said outer peripheral edges having opposite toe and heel portion and opposite sides, pad means of compressible open cell foam plastic material located within said chamber, said pad means being of a size to substantially fill said chamber, said chamber of the case means having an internal dimension less than the fully expanded corresponding dimension of the pad means whereby the pad means is retained under partial compression within the chamber by the walls of the case means, said outer peripheral edges having at least one small opening to allow restricted air flow into and out of the chamber and open cells of the pad means thereby regulating the pressure of the air in the chamber and open cells of the pad means and flow of air out of the open cells of the pad means and chamber whereby the pad means and air in the open cells of the pad means simultaneously absorb and distribute impact forces applied to the foot during walking and running activities.

24. The cushion of claim 23 wherein: said outer peripheral edges have openings in the toe and heel portion thereof.

25. The cushion of claim 24 wherein: said outer peripheral edges include openings in at least one side thereof.

26. The cushion of claim 23 wherein: said outer peripheral eges have openings in the opposite sides thereof.

27. A protective cushion comprising: a pad of air entrained, springy compressible open cell plastic material, a case surrounding said pad having a pair of sheet members forming a single chamber accommodating said pad, said sheet members having adjacent outer peripheral edges connected together to enclose the entire pads between the sheet members, said sheet members being of an air impervious flexible material, said pad being of a size to substantially fill internal chamber, said chamber having an internal dimension less than the fully expanded corresponding dimension of the pad whereby the sheet members retain the pad in partial compression within the chamber, and means located in said outer peripheral edges regulating permissible air flow out of the chamber and open cells of the pad and the pressure of the air in the open cells of the pad upon compression of the pad due to impact of an external force whereby the pad ;and the air in the open cells of the pads simultaneously absorb and distribute impact forces applied thereto and flow of air into the chamber and the open cells of the pad upon expansion of the pad, said means regulating air flow including at least one opening in the outer peripheral edges of the sheet members.

28. The cushion of claim 27 wherein: said outer peripheral edges have opposite sides and opposite ends, said means regulating air flow including at lealst one opening in the opposite ends and opposite sides of the peripheral edges of the sheet members.

29. The cushion of claim 27 wherein: said outer peripheral edges have opposite ends, said opening being located in one of the ends of the peripheral edges.

30. The cushion of claim 27 wherein: said peripheral edges have opposite ends, said opening being located in at least one of said ends.

31. The cushion of claim 27 wherein: the cushion has the general shape of the bottom of a person's foot.

32. The cushion of claim 27 wherein: the cushion has a chest portion and a shoulder portion, one side of said cushion has a recess to accommodate a neck of a person.

* * * * *